US006200360B1

(12) United States Patent
Imai et al.

(10) Patent No.: US 6,200,360 B1
(45) Date of Patent: Mar. 13, 2001

(54) ABRASIVE TOOL AND THE METHOD OF PRODUCING THE SAME

(75) Inventors: Tomoyasu Imai, Kariya; Hiroaki Asano, Okazaki; Hayashi Kodama, Handa; Masato Kitajima, Hekinan; Masashi Yanagisawa, Okazaki, all of (JP)

(73) Assignees: Toyoda Koki Kabushiki Kaisha, Kariya; Toyoda Van Moppes Kabushiki Kaisha, Okazaki, both of (JP)

( * ) Notice: Subject to any disclaimer, the term of this patent is extended or adjusted under 35 U.S.C. 154(b) by 0 days.

(21) Appl. No.: 09/289,954

(22) Filed: Apr. 13, 1999

(30) Foreign Application Priority Data

Apr. 13, 1998 (JP) ..... 10-115877
Apr. 16, 1998 (JP) ..... 10-121622

(51) Int. Cl.[7] ..... B24D 3/00; B24D 17/00; B24D 18/00; B24D 3/06; B24D 3/10

(52) U.S. Cl. ..... 51/307; 51/293; 51/295; 451/548; 451/540; 428/143

(58) Field of Search ..... 51/307, 293, 309, 51/295; 451/547, 548, 540; 428/143, 161, 168

(56) References Cited

U.S. PATENT DOCUMENTS 3,641,718 * 2/1972 Ferchland ..... 451/548
4,923,490 * 5/1990 Johnson et al. ..... 51/309
5,190,568 * 3/1993 Tselesin ..... 51/293
5,239,784 8/1993 Stanfield .
5,435,816 * 7/1995 Spurgeon et al. ..... 51/295
5,669,943 * 9/1997 Horton et al. ..... 51/307
5,976,001 * 11/1999 Powell et al. ..... 451/540
5,997,597 * 12/1999 Hagan ..... 51/309

FOREIGN PATENT DOCUMENTS 60-39071 2/1985 (JP) .
61-181666 11/1986 (JP) .
62-7361 1/1987 (JP) .
62-47669 10/1987 (JP) .
4-223871 8/1992 (JP) .

* cited by examiner

*Primary Examiner*—Michael Marcheschi
(74) *Attorney, Agent, or Firm*—Oblon, Spivak, McClelland, Maier & Neustadt, P.C.

(57) ABSTRACT

An abrasive tool includes an electroformed layer having superabrasive grains electroplated on an outer surface of the electroformed layer, and a plurality of dimples arranged on the outer surface of the electroformed layer using a mold with projections made of gel adhesive. The concentration of the abrasive gains is regulated by changing the number of the dimples (i.e., changing a dimple-area-rate). The gel adhesive preferably has a viscosity of 500,000 cP or smaller. The dimple-area-rate is preferably from 7 to 70%.

23 Claims, 6 Drawing Sheets

ABRASIVE TOOL AND THE METHOD OF PRODUCING THE SAME

BACKGROUND OF THE INVENTION

1. Field of the Invention

The present invention relates to an abrasive tool for grinding, dressing, shaping or the like and also relates to a method of producing the same.

2. Description of the Related Art

Grinding wheels, a kind of abrasive tool, including polycrystalline diamond grains or cubic boron nitride grains (CBN) (i.e., superabrasive grains) have been proposed, e.g., in U.S. Pat. No. 4,923,490. Conventionally, an electrodeposited superabrasive grinding wheel includes diamond grains or CBN grains electroplated thereon. The electroplating enables the grinding wheel to copy a mold profile in detail with high precision because the manufacturing process proceeds at a relatively low temperature compared with sintering. Therefore, an electroplated grinding wheel makes possible high precision grinding, especially for high hardness and complex workpieces, so as that the demand for such grinding wheels is rising.

However, the grinding wheel tends to have a high concentration of the superabrasive grains because the grains are densely fixed on the outer peripheral surface of the grinding wheel. The high concentration of the superabrasive grains works against the engagement between the grinding wheel and the workpiece so as to increase the grinding force.

Diamond dressers, another kind of abrasive tool, have been proposed, e.g., in Japanese Published Patent Applications (Tokukoushou) 62-47669 and 53-11112. Japanese Published Patent Application 62-47669 discloses a diamond dresser whose concentration of the diamond grains is regulated by glass beads and metal balls manually prearranged on a mold using an adhesive. The percentage of the area filled with the beads and the balls determines the concentration of the diamond grains. However, it is difficult to coordinate the size of the beads or the balls.

Japanese Published Patent Application 53-11112 discloses a diamond dresser having a plurality of spiral grooves on its surface to reduce the dressing force. However, the dressing force changes whenever the grooves pass through the surface of the workpiece, so that vibrations may occur.

SUMMARY OF THE INVENTION

Accordingly, it is an object of the present invention to provide an improved abrasive tool having a preferable abrasive concentration to reduce abrasive machining force (e.g., grinding force and dressing force) and a method of producing the same.

Briefly, this and other objects of this invention as hereinafter will become more readily apparent as having been attained broadly by an abrasive tool including an electroformed layer having superabrasive grains electroplated on an outer surface of the electroformed layer, and a plurality of dimples arranged on the outer surface of the electroformed layer.

The concentration of the abrasive grains in the grinding tool is easily regulated by changing the number of the dimples (i.e., changing a dimple-area-rate). Therefore, the abrasive tool has a preferable concentration so as to effectively engage a workpiece to provide excellent abrasive machining efficiency, because the dimples catch chips broken off from the workpiece during abrasive machining. Thus the abrasive machining force (e.g., grinding force and dressing force) is reduced.

Since the dimples also retain coolant to cool the superabrasive grains, wear of the superabrasive grains is reduced, so that life of the abrasive tool is extended.

Moreover, the abrasive tool maintains high-precision abrasive machining for a long time because the outer surface of the abrasive tool is uniformly dotted with the dimples.

For producing an abrasive tool, a gel adhesive is arranged on an electrically conductive mold to form a plurality of projections. Next, the superabrasive grains are arranged on the mold and are temporarily fixed on the mold by electroplating. After removing non-electroplated superabrasive grains from the mold, an electroformed layer is made to fix the superabrasive grains on the mold by re-electroplating. Finally, the mold is removed with the projections, to form dimples.

Since the projections for the dimples are made of a gel adhesive, they are easily produced and the dimples are simply formed by removing the mold with the projections.

Therefore, the abrasive tool is produced simply and inexpensively. By changing the shape, number, density, location or size of the projections, desired dimples are easily produced. The shape of the nozzle discharging the gel adhesive determines the projection profile corresponding to the shape of the dimples. The size of the dimple depends on the amount of discharged gel adhesive. As described above, the dimple-area-rate is also changed easily to produce desired abrasive tool with a preferable concentration.

In the case that the gel adhesive is an electrically insulating material, few superabrasive grains locate in the dimples because the superabrasive grains on the projections are not electroplated. This minimizes the usage of the superabrasive grains to reduce the cost of the abrasive tool.

The gel adhesive preferably has a viscosity of 500,000 cP or smaller, and the dimple-area-rate is preferably from 7 to 70% in the abrasive tool.

BRIEF DESCRIPTION OF THE ACCOMPANYING DRAWINGS

Various other objects, features and many of the attendant advantages of the present invention will be readily appreciated as the same becomes better understood by reference to the following detailed description of the preferred embodiments when considered in connection with the accompanying drawings, in which.

Figure 9:
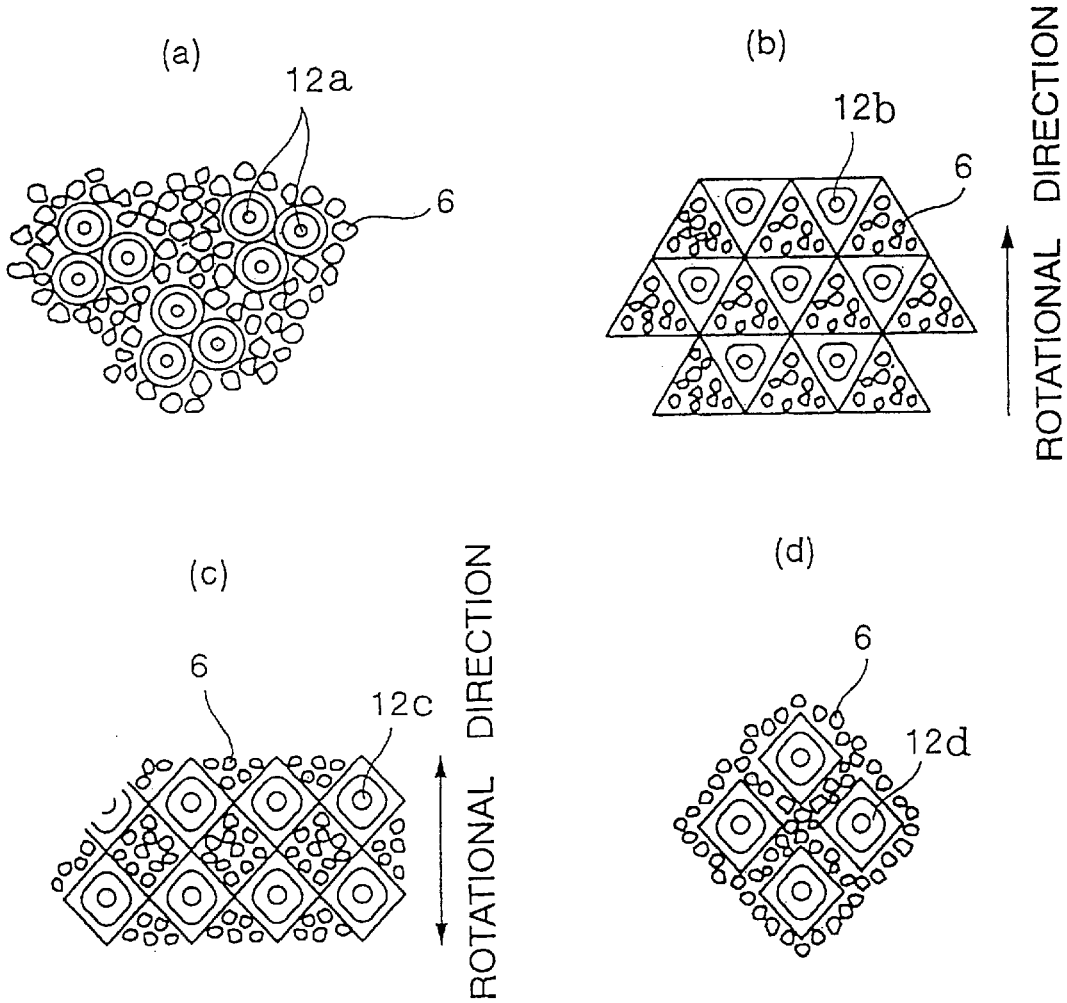
Figure 10:
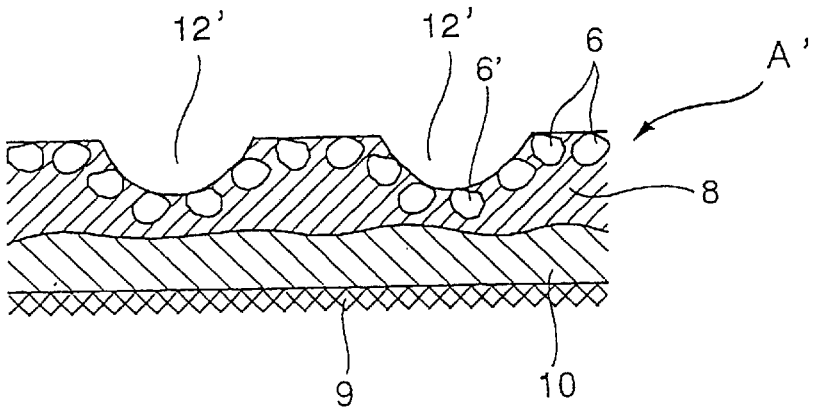
Figure 11:
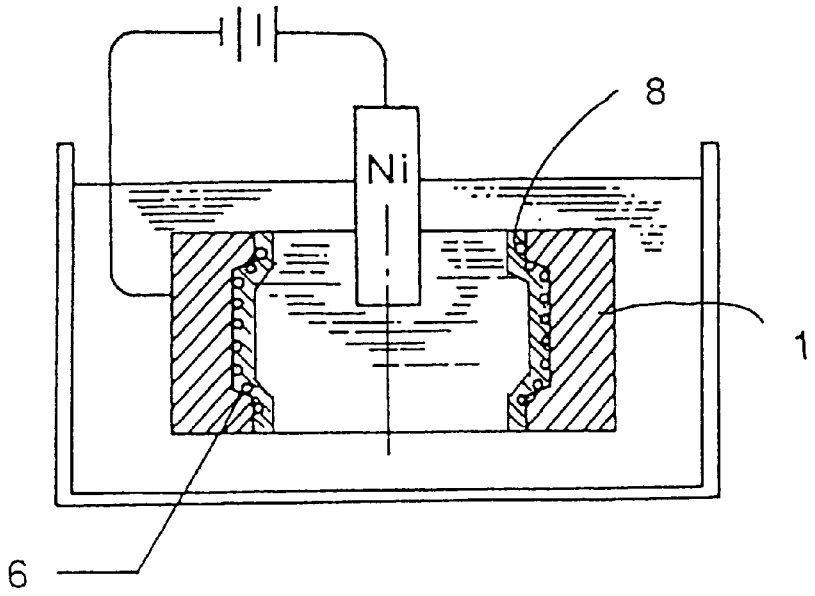
Figure 12:
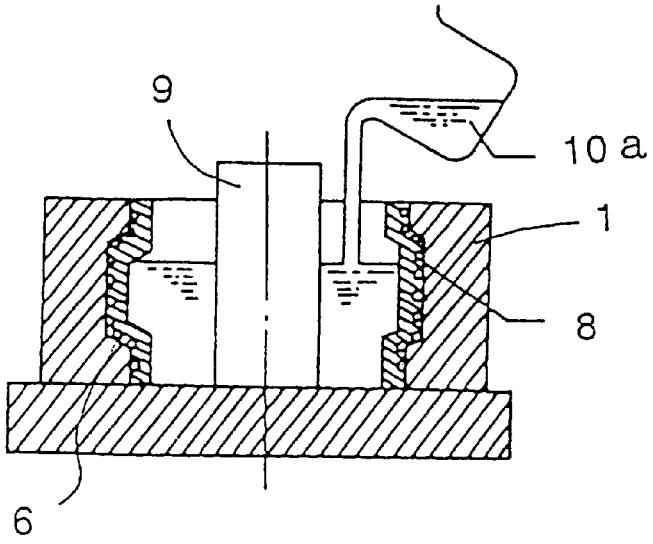
Figure 13:
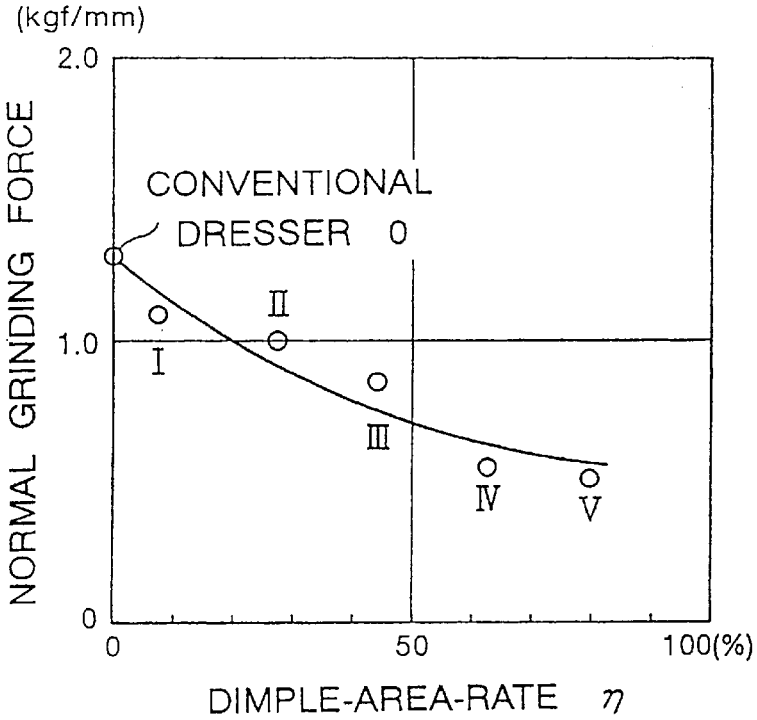
Figure 14:
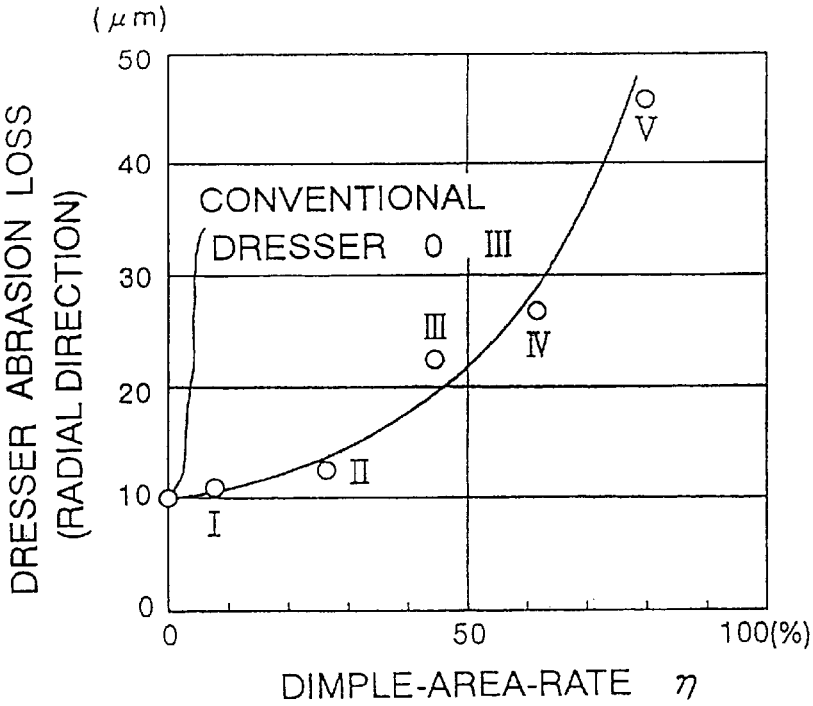

FIGS. 9(*a*), (*b*), (*c*) and (*d*) are plan views showing a part of an outer surface of the abrasive tool according to modifications of the embodiment;

FIG. 10 is a sectional view of an abrasive tool according to another embodiment;

FIG. 11 is a sectional view showing a step of a producing process of the abrasive tool;

FIG. 12 is a sectional view showing a step of the producing process of the abrasive tool;

FIG. 13 is a graph showing a relationship between a dimple-area-rate and normal grinding force; and FIG. 14 is a graph showing a relationship between the dimple-area-rate and dresser abrasion loss.

DETAILED DESCRIPTION OF THE PREFERRED EMBODIMENTS (First embodiment)

FIGS. 1 to 6 show various steps used in producing a grinding wheel A. Each sectional view of FIGS. 1 to 6 respectively shows a part of an outer surface of the grinding wheel A and an inner surface of a mold 1. The grinding wheel A has a cylindrical or disc shape, and the mold 1 has a ring shape corresponding to the grinding wheel shape, as seen in FIGS. 11 and 12.

Figure 8:
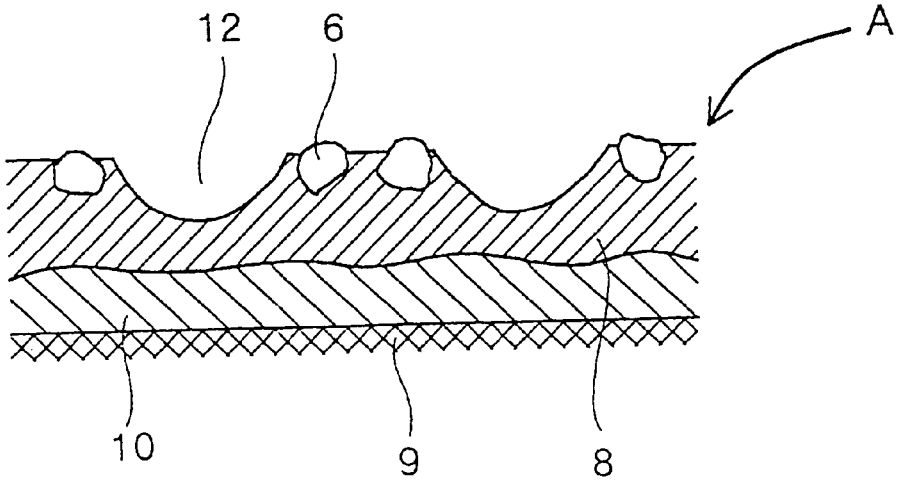
FIG. 8 is a sectional view of the abrasive tool of FIG. 7 taken along the line I—I.

As shown in FIG. 8, the grinding wheel A includes an electroformed layer 8 mounted on a fused alloy layer 9. The electroformed layer 8 is dotted with dimples 12 to form the outer surface of the grinding wheel A, and contains superabrasive grains 6 (i.e., polycrystalline diamond grains, cubic boron nitride grains (CBN), or the like). However, there are few superabrasive grains in the dimples 12. The process of producing the grinding wheel A is explained hereinafter.

Figure 1:
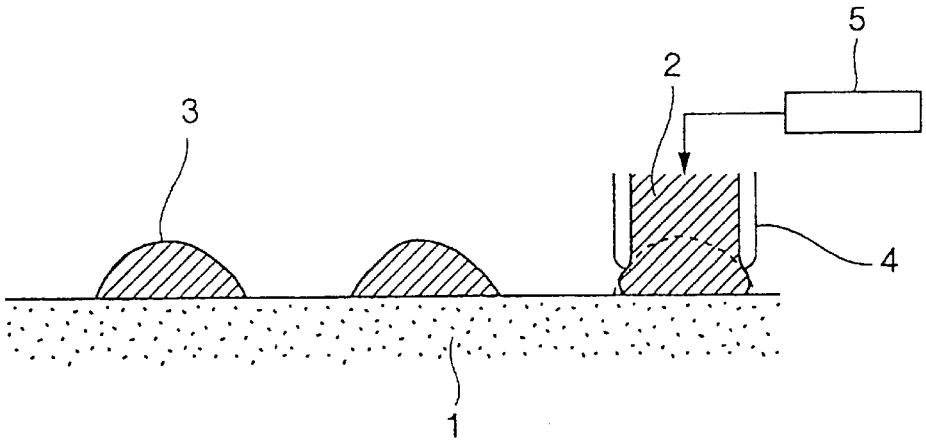
FIG. 1 is a sectional view showing a step of a producing process of an abrasive tool according to an embodiment of the present invention.

As shown in FIG. 1, a delivery device 5 may have a cylindrical or tubular nozzle 4 to put a predetermined amount of electrically insulating gel adhesive 2 (e.g., a cyanoacrylate gel instant glue) on the inner surface of the mold 1 made of electrically conductive material (e.g., graphite). The adhesive 2 instantly solidifies on the mold 1 to form an approximate hemispheric projection 3. The projection 3 serves as a part of the mold 1 to make a dimple 12. The number of projections 3 on the mold 1 determines the density of the dimples 12 on the grinding wheels A.

The size of the dimple 3 substantially depends on the size of the nozzle 4 and discharge amount of the adhesive 2 from the nozzle 4. Therefore, the concentration of dimples 12 on the grinding wheel is easily regulated by changing the size and/or number of the projections 3.

The electrically insulating gel adhesive 2 in this embodiment may be a THREEBOND 1739 of an instantaneous powerful adhesive, gel type (viscosity 23,000 cP (centipoise)). As is apparent, other types of adhesive can be used. Preferably, the viscosity of the adhesive is 500,000 cP or smaller in order to keep its shape on the mold 1 and easily form a desired shape (e.g., the hemispheric shape) of the projection 3.

The delivery device 5 may be a commercially available device commonly known as a "dispenser." The delivery device 5 may be manually operated or controlled by numerical control. In case of using numerical control, the nozzle 4 of the delivery device 5 automatically deposits the adhesive drops at predetermined points on the mold 1 by programming.

Figure 2:
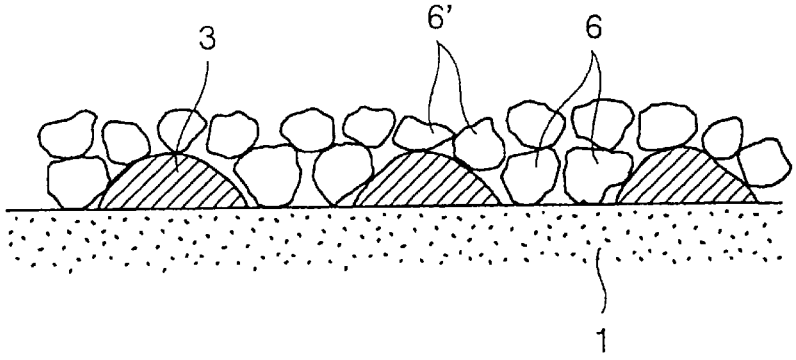
FIG. 2 is a sectional view showing a step of the producing process of the abrasive tool according to the embodiment.

As shown in FIG. 2, after the adhesive hemispheric projections 3 solidify, the inner The superabrasive grains 6 located on the area with no projections 3 contact the surface of the mold 1. The superabrasive grains 6' located on the projections 3 do not contact the surface of the mold 1.

Next, by electroplating (e.g., nickel-plating) the mold 1 in a plating bath, the plated layer 7 is formed between the superabrasive grains 6 and the surface of the mold 1. Therefore, the superabrasive grains 6 contacting the mold 1 are electrodeposited on the surface of the mold 1 (shown in FIG. 3) by the plated layer 7 to temporarily fix the superabrasive grains 6 on the mold 1. On the other hand, the superabrasive grains 6' on the projections 3 are not electrodeposited because the projections 3 are made of the electrically insulating gel adhesive 2.

Then the superabrasive grains 6' on the projections 3 are removed from the mold 1. This is easily done because the superabrasive grains 6' are not fixed by the plated layer 7. As a result, there are few superabrasive grains 6' on the projections 3 (shown in FIG. 4).

Figure 5:
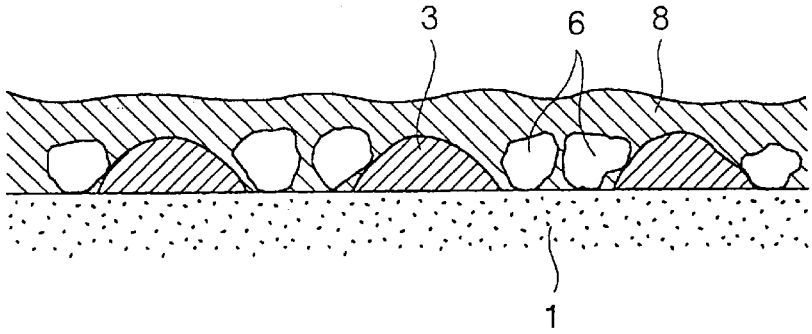
FIG. 5 is a sectional view showing a step of the producing process of the abrasive tool according to the embodiment.
Figure 6:
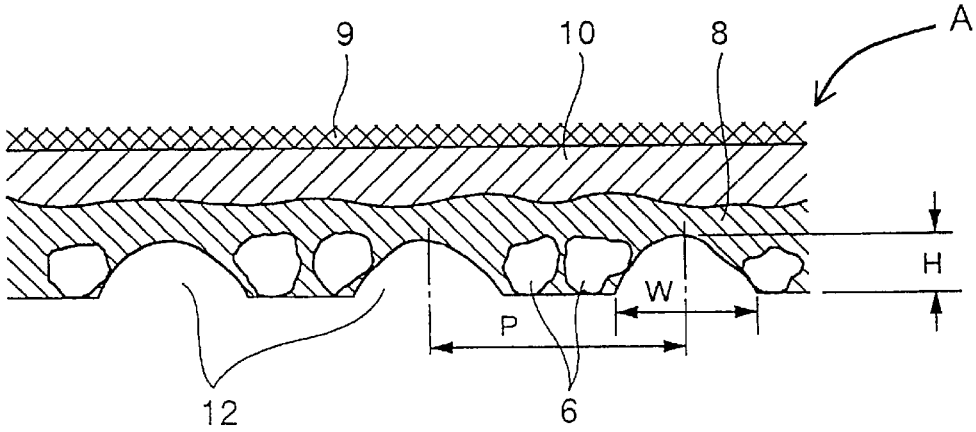
FIG. 6 is a sectional view showing a step of the producing process of the abrasive tool according to the embodiment.

After that, as shown in FIGS. 5 and 11, the electroformed layer 8 is formed on the inner surface of the mold 1 by re-electroplating (e.g., nickel-plating) to cover over the superabrasive grains 6. The electroformed layer 8 is thicker than the diameter of the superabrasive grains 6, to certainly fix the superabrasive grains 6 on the mold 1.

Other methods such as electroless plating (i.e., chemical plating) can be used instead of electroplating to fix the superabrasive grains 6. For example, the mold 1 in the state shown in FIG. 4 may be soaked in an electroless nickel-phosphorus-plating bath for about 180 hours so as to form a nickel-phosphorus-plated layer with about a 3 mm thickness, that is enough to fix the superabrasive grains 6 on the mold 1. In general, the diameter of the superabrasive grains 6 is smaller than 1 mm.

After mounting a metal core 9 in the center of the mold 1 shown in FIG. 12, the clearance between the inner surface of the mold 1 and the core 9 is filled with fused alloy 10*a* (e.g., tin alloy) to form the fused alloy layer 10. The fused alloy layer 10 bonds the electroformed layer 8 to the core 9.

Synthetic resin can be used instead of the fused alloy to bond the electroformed layer 8 to the core 9. For example, epoxy resin, phenol resin or the like may be used because these resins have a high adhesive property for metal and high mechanical strength. Adhesives made of epoxy resin or phenol resin also can be used.

Finally, the ring-shaped mold 1 is removed by cutting or grinding to complete the grinding wheel A. When removing the mold 1, the projections 3 are simultaneously removed from the outer surface of the electroformed layer 8, so that the dimples 12 remain on the outer surface of the grinding wheel A (shown in FIG. 6). The width W, pitch P and depth H of the dimples 12 are easily regulated by changing the profiles of the projections 3.

Figure 7:
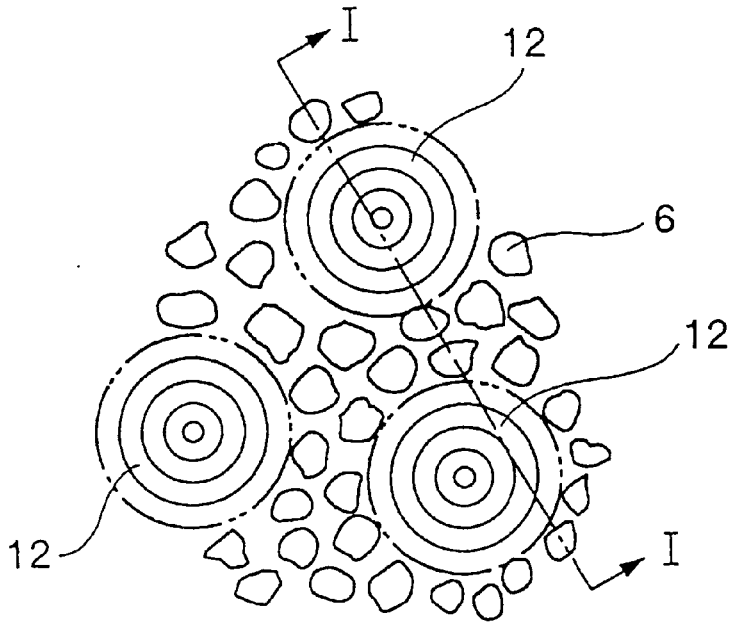
FIG. 7 is a plan view showing a part of an outer surface of the abrasive tool according to the embodiment.

FIG. 7 shows the surface of the grinding wheel A including the area of the superabrasive grains 6 and the dimples 12 arranged in a predetermined order. FIG. 8 is a sectional view of the grinding wheel A of FIG. 7 taken along the line I—I. As shown in FIG. 8, the dimples 12 contain few superabrasive grains 6, to minimize use of the superabrasive grains 6.

The width W of each dimple 12 is preferably from 3 to 20 times larger than the average diameter of the superabrasive grains 6. The depth H of each dimple 12 is preferably from 0.5 to 5 times bigger than the average diameter of the superabrasive grains 6. With these numerical limits, chips broken off when grinding a workpiece are easily removed, and grindability of the grinding wheel A is enhanced because the dimples 12 catch the chips. Moreover, since coolant stays in the dimples 12 to reduce frictional heat during grinding, heat deterioration wear caused by frictional heat, one of main factors in grain wear, is decreased so as that the life of the grinding wheel is extended.

The following experiment using the grinding wheel A was carried out to confirm the effects of the dimples 12. A grinding wheel A (diameter 175 mm, width 5 mm, bore diameter 31.75 mm) was made in compliance with the above-described producing processes. Conductive graphite material was used for the ring shaped mold 1. The insulating adhesive 2 was a THREEBOND 1739 of an instantaneous powerful adhesive (viscosity 23,000 cP). An automatic precision dispenser served as the delivery device 5, which included the nozzle 4 with a cylindrical tip having a diameter of 0.42 mm. The discharge pressure and the discharge time of the automatic precision dispenser were set to produce projections 3 with a diameter of 1.5 mm after solidification. The dimple density was 16 dimples/$cm^2$ (i.e., a dimple-area-rate 28.27%). The dimple density is defined as the number of dimples in 1 $cm^2$ of the outer surface of the grinding wheel A. The dimple-area-rate is the percentage of the gross area occupied by the dimples 12 in 1 $cm^2$ of the outer surface of the grinding wheel A.

After the projections 3 solidified at room temperature, the mold 1 was set in a jig to provide the superabrasive grains 6 on the inner surface of the mold 1. The superabrasive grains 6 were CBN grains with a size of #120/#140(mesh).

Next, the mold 1 was brought into the plating bath and an electric current density of 0.1 to 0.15 A/$dm^2$ was applied to temporarily fix the superabrasive grains 6 on the mold 1 to form the plated layer 7.

After the temporary plating, the extra superabrasive grains 6' were removed, and the mold 1 was nickel-electroplated in the main plating bath with a current density of 2.0 A/$dm^2$ for 85 hours to form the electroformed layer 8, as shown in FIG. 11. Then the iron core 9 (S45C) was coaxially mounted in the mold 1, the clearance between the nickel-electroformed layer 8 and the core 9 was filled with low melting point fused alloy 10*a* (i.e., a low melting point metal) including tin at a temperature of 200° C. to bond them, as in FIG. 12. Finally, the mold 1 was removed by cutting and finished by grinding with a grinding wheel of WA#220 to complete the grinding wheel A having the dimples 12.

A CBN grinding wheel with no dimples 12 was also produced in the same way, except for the process of making the dimples 12, to compare it with the grinding wheel A having the dimples 12.

A grinding test of the CBN grinding wheels was performed. The test was conducted under the following grinding conditions to determine the normal grinding force:

Grinding machine: surface grinding machine
Coolant: soluble oil type (70.0 times dilution)
Circumferential speed of grinding wheel: 33 m/s
Workpiece: SUJ(HE) (50.0 mm×3.0 mm, thickness 30.0 mm)
Feed speed of workpiece: 90.0 mm/min (up-cutting)
Depth of grinding wheel cut: 0.5 mm/pass
Finishing allowance: 2.0 mm As a result of the test, it was found that 0.35 kgf/mm was the normal grinding force of the grinding wheel A with the dimples 12, and 0.51 kgf/mm was the normal grinding force of the conventional grinding wheel with no dimples 12. The normal grinding force was thus reduced by about 31% due to the dimples 12.

FIGS. 9*a*–9*d* show modified dimples 12*a*, 12*b*, 12*c* and 12*d* produced by nozzles with a corresponded sectional shape. FIG. 9(*a*) shows several (e.g., three) hemisphere dimples 12*a* adjoining each other to enlarge the dimple area. It encourages removal of the chips and holding the chips and the coolant in the dimples 12*a* so as to enhance the cooling effect.

FIGS. 9(*b*) and 9(*c*) respectively show triangular pyramid dimples 12*b* and quadrangular pyramid dimples 12*c*. Each superabrasive grain area also forms a triangle or a quadrilateral. In addition, the apex of a triangle or a quadrilateral area corresponds to a rotational direction of the grinding wheel. This enhances engagement between the grinding wheel and the workpiece to improve grinding efficiency. Since each of the dimples 12*b* and 12*c* is positioned behind the superabrasive grain area in the rotational direction of the grinding wheel, the chips are effectively removed so as to reduce the grinding force.

FIG. 9(*d*) shows quadrangular pyramid dimples 12*d* and a checkered superabrasive grain area. The superabrasive grain area surrounds the dimples. Therefore, the abrasive grains uniformly cover the outer surface of the grinding wheel to decrease surface roughness of the workpiece compared with the modifications of FIGS. 9(*b*) and 9(*c*), even when the dimple-area-rate is relatively large.

As is apparent, the location, the size, the number or the like of the dimples 12 also can be modified.

(Second embodiment)

The second embodiment is also related to a grinding wheel A' of an abrasive tool. The projections of the grinding wheel A' are made of electrically conductive gel adhesive instead of the insulating gel adhesive 2 of the first embodiment. In the second embodiment, the conductive gel adhesive is a THREEBOND 3300 series conductive resin adhesives or insulating adhesive containing conductive powder, e.g., silver powder. The grinding wheel is basically produced in the same way as that of the first embodiment.

Figure 3:
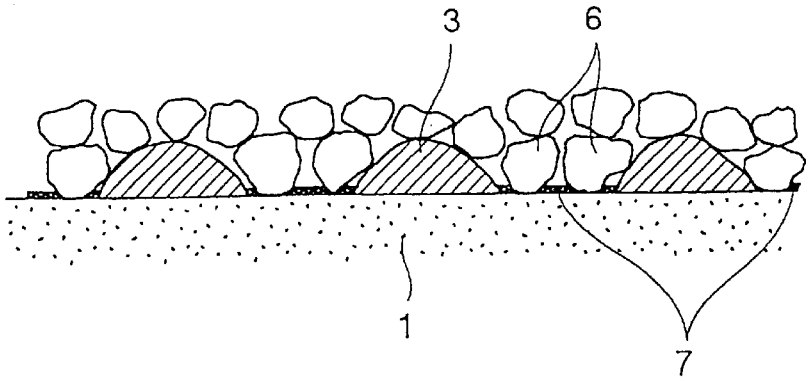
FIG. 3 is a sectional view showing a step of the producing process of the abrasive tool according to the embodiment.
Figure 4:
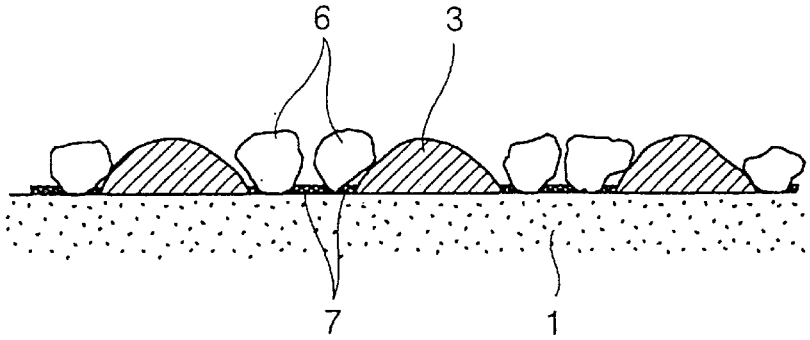
FIG. 4 is a sectional view showing a step of the producing process of the abrasive tool according to the embodiment.

Since the projections 3 contain the conductive materials in FIG. 3, not only the superabrasive grains 6 on the mold 1 but also grains 6' on the projections 3 are temporarily electroplated. As a result, the grinding wheel A' includes the superabrasive grains 6' in the area of the dimples 12', so that the superabrasive grains 6 and 6' are distributed all over the outer surface of the grinding wheel A' (shown in FIG. 10). In the second embodiment, as the dimples 12' are supported by the superabrasive grains 6' to keep the dimple shape, the effect of the dimples 12' is enhanced.

(Third embodiment)

The third embodiment is related to a diamond rotary dresser used for dressing a grinding wheel. Since the construction and producing process of the third embodiment are substantially the same as those of the first embodiment, the third embodiment is described using the reference numbers of the first embodiment and the descriptions of the same parts are omitted.

The diamond dresser includes an electroformed layer 8 mounted on a fused alloy layer 10. The electroformed layer 8 contains polycrystalline diamond grains 6.

In the third embodiment, the width W of each dimple 12 is preferably from 3 to 20 times bigger than the average diameter of the diamond grains 6. The depth H of the dimple 12 is preferably from 0.5 to 5 times bigger than the average diameter of the diamond grains 6. With these numerical limits, the chips are easily removed and dressing efficiency is enhanced. Moreover, since coolant stays in the dimples 12 to reduce the frictional heat when dressing a grinding wheel, the heat deterioration wear caused by frictional heat, one of main factors in grain wear, decreases so as that the life of the diamond dresser is extended.

Since it is assumed that a dimple-area-rate affects the capability of the diamond dresser, the following test was run to determine the effect of the dimples 12. The dimple-area-rate $\eta$ is the percentage of the gross area occupied by the dimples 12 in 1 $cm^2$ of the outer surface of the diamond dresser A.

Five diamond dressers I to V (diameter 80 mm, width 15 mm) with different dimple-area-rates were made in compliance with a following producing process. Graphite material was used for the ring shaped mold 1 as the conductive material. The insulating adhesive 2 was a THREEBOND 1739 of an instantaneous powerful adhesive (viscosity 23,000 cP). An automatic precision dispenser served as the delivery device 5, which included a nozzle 4 with a cylindrical tip having a diameter of 0.42 mm. The discharge pressure and the discharge time of the automatic precision dispenser was set to produce projections 3 with a diameter of 1.5 mm after solidification. By changing the number of the dimples 12, each dresser had a different dimple disposing density defined as the number of the dimples in 1 $cm^2$ of the outer surface of the diamond dresser.

After the projections 3 solidified at room temperature, the mold 1 was set in a jig to provide the diamond rains 6 on the inner surface of the mold 1. Diamond grains 6 with a size of #25/#30(mesh) were used.

Next, the mold 1 was brought into the plating bath and an electric current density of 0.1 to 0.15 $A/dm^2$ was applied to temporarily fix the diamond grains 6 on the mold 1 to form the plated layer 7.

After the temporary plating, the extra superabrasive grains 6' were removed, and the mold 1 was nickel-electroplated in the main plating bath with an electric current density of 2.0 $A/dm^2$ for 90 hours to form the electroformed layer 8, as shown in FIG. 11.

Then, after coaxially mounting the iron core 9 (S45C) in the mold 1, the clearance between the nickel-electroformed layer 8 and the core metal 9 was filled with low melting point fused alloy 10*a* (low melting point metal) including tin, as in FIG. 12.

Finally, the mold 1 was removed, with a remaining thickness of about 1 mm, by lathe turning, and finished for the remained thickness by grinding with a grinding, wheel (WA stick) to complete the diamond rotary dresser A having the dimples 12. The projections 3 were removed by the grinding.

The five diamond rotary dressers I to V respectively had 4, 16, 26, 36 and 46 dimples/$cm^2$ as the disposing density for making the dimples 12.

A conventional diamond rotary dresser O with no dimples 12 was also produced in the same way, except for the process of making the dimples 12, to compare it with the diamond rotary dressers I to V having the dimples 12.

Specifications of the five diamond rotary dressers I to V and the conventional diamond rotary dresser O are shown in Table 1.

A grinding test and an abrasion test with the diamond rotary dressers were performed. The grinding test used ceramic grinding wheels respectively dressed by the diamond rotary dressers I to V and the conventional dresser O. The test was conducted under the following grinding conditions to determine each normal grinding force:

Grinding machine: cylindrical grinding machine
Grinding wheel: MPD120L8V (Ø405.0 mm×10.0 mm(width))
Coolant: soluble oil type (70 times dilution)
Circumferential speed of grinding wheel: 50 m/s
Circumferential speed of dresser: 14.7 m/s (down dressing)
Feed speed of dresser: Ø2.4 mm/min (dress out 2 sec)
Depth of dressing cut: Ø40.0 μm
Workpiece: SUJ(HE) (Ø60.0 mm×15.0 mm(width))
Circumferential speed of workpiece: 50 m/min (up-cutting)
Feed speed of grinding wheel: Ø3.6 mm/min
Finishing allowance: Ø0.2 mm Results of the test are shown in Table 1 and FIG. 13.

The abrasion test of the diamond dressers was conducted to determine the abrasion loss of the dressers after dressing a grinding wheel under the following dressing conditions:

Grinding machine: cylindrical grinding machine
Grinding wheel: A54M7V (Ø405.0 rpm×30.0 mm(width))
Circumferential speed of grinding wheel: 30 m/s
Circumferential speed of dresser: 4.2 m/s (down dressing)
Feed speed of dresser: Ø0.4 mm/min
Dressed amount of grinding wheel: 5000.0 $cm^3$/cm
Coolant: soluble oil type Results of the test are shown in Table 1 and FIG. 14. In Table 1, the conventional dresser O with no dimples 12 is shown as the dimple-area-rate η of 0%.

TABLE 1

| Dresser | I | II | III | IV | V | O |
|---|---|---|---|---|---|---|
| Dimple-area-rate η (%) | 7 | 28 | 46 | 63 | 80 | 0 |
| Disposing density (dimples/$cm^2$) | 4 | 16 | 26 | 36 | 46 | 0 |
| Normal grinding force (kf/mm) | 1.08 | 0.99 | 0.87 | 0.54 | 0.50 | 1.28 |
| Dresser abrasion loss (μm) | 11 | 13 | 23 | 27 | 46 | 10 |

The graphs of FIGS. 13 and 14 are based on Table 1. FIG. 13 shows effect of the dimples 12 in the normal grinding force. It can be seen that the normal grinding force decreases from the diamond dresser I with the dimple-area-rate η of 7%, compared with the conventional dresser O. The bigger the dimple-area-rate, the smaller the normal grinding force. On the other hand, FIG. 14 shows that the radial abrasion loss of the dresser suddenly increases approximately from the dimple-area-rate η of 70%.

The reason for the above tendency shown in FIGS. 13 and 14 is considered as follows. When the number of the dimples 12 increases (i.e., the dimple-area-rate η increases), the number of the effective diamond grains 6 decreases, so as that the engagement between the dresser and the workpiece increases to improve the dressing efficiency, and the cooling effect for the diamond grains 6 is enhanced because of the dimples 12. Therefore, it is considered that the grindability of the grinding wheel dressed by the diamond dresser with the dimples 12 is improved, as in FIG. 13.

However, since the number of the effective diamond grains 6 decreases, it is considered that load of dressing grows for each diamond grain 6, so as that the abrasion loss of the dresser increases due to friction when dressing, as in FIG. 14.

Therefore, the dimple-area-rate η of 7 to 70% is preferable for the diamond dresser.

As with the first embodiment, modifications of the dimples 12 shown in FIGS. 9(*a*), (*b*), (*c*) and (*d*) can be used for the diamond dresser of the third embodiment.

(Fourth embodiment)

The fourth embodiment is related to a diamond dresser produced by substantially the same process as that of the second embodiment of the grinding wheel. Therefore, the description of the fourth embodiment refers to FIG. 10 as follows.

The projections for the diamond dresser A' are made of conductive gel adhesive instead of the insulating gel adhesive 2 in the third embodiment. In the fourth embodiment, the conductive gel adhesive is a THREEBOND 3300 series conductive resin adhesive or insulating adhesive containing conductive powder, e.g., silver powder. Therefore the diamond dresser A' includes the diamond grains 6' in the area of the dimples 12', and the diamond grains 6 and 6' are distributed all over the outer surface of the diamond dresser A' (shown in FIG. 10).

In the fourth embodiment, as the dimples 12' are supported by the diamond grains 6' to keep the dimple shape, the effect of the diamond rotary dresser A' with the dimples 12' is maintained for a long time.

(Fifth embodiment)

The fifth embodiment is also related to a diamond dresser whose diamond grains are mounted on a flat plate. The producing process is substantially the same as that of the third embodiment except for the shape of the mold and the core. The mold is made of graphite material with a flat surface. Described hereinafter are different conditions from those of the third embodiment.

The diamond dresser has the dimple-area-rate θ of 28%, a dimple size of approximately Ø1.5 mm and an average density of the diamond grains of 120 to 140 grains/cm$^2$.

A conventional flat diamond dresser with no dimples was also produced in the same way except for the process of making the dimples 12 to compare it with the dresser having the dimples. Since the conventional diamond dresser did not include dimples, the average density of the diamond grains was from 180 to 200 grains/cm$^2$.

A grinding test with both the diamond dressers was performed. Specifications of dressing conditions and grinding conditions are shown as follows:

Grinding machine: surface grinding machine
Grinding wheel: CBN120L150VBA (Ø175.0 mm×5.0 mm(width))
Coolant: soluble oil type (70 times dilution)
Circumferential speed of grinding wheel: 33 m/s
Feed speed of dresser: 750 mm/min
Depth of dressing, cut: 0.0025 mm/pass×6 times (down-dressing)
Workpiece: SUJ(HE) (50.0 mm(length)×3.0 mm(width))
Feed speed of workpiece: 90 m/min (up-cutting)
Depth of grinding wheel cut: 0.5 mm/pass×4 times
Finishing allowance: 2.0 mm As a result of the test, it was found that the normal grinding force used by the dresser with dimples was 0.33 kgf/mm. The normal grinding force used by the conventional dresser with no dimples was 0.45 kgf/mm. Thus by adopting the dimples, the normal grinding force was reduced by about 25%.

Obviously, numerous modifications and variations of the present invention are possible in light of the above teachings. It is therefore to be understood that within the scope of the appended claims, the present invention may be practiced otherwise than as specifically described herein.

What is claimed is:

1. An abrasive tool comprising:

an electroformed layer having superabrasive grains electroplated on a surface of said electroformed layer; and a plurality of dimples arranged on the surface of said electroformed layer.

2. An abrasive tool according to claim 1, wherein said electroformed layer includes superabrasive grains in said dimples.

3. An abrasive tool according to claim 1, wherein said superabrasive grains are one selected from the group consisting of diamond grains and cubic boron nitride grains.

4. An abrasive tool according to claim 1, wherein said abrasive tool is a grinding wheel.

5. An abrasive tool according to claim 1, wherein said abrasive tool is a diamond dresser, and said superabrasive grains are diamond grains.

6. An abrasive tool according to claim 5, wherein said diamond dresser includes said dimples with a dimple-area-rate of 7 to 70%.

7. An abrasive tool according to claim 1, further comprising a core and a fused material layer made of a fused material bonded between said core and said electroformed layer, said surface of said electroformed layer having said dimples arranged thereon being opposite a surface of said electroformed layer bonded to said fused material layer.

8. An abrasive tool according to claim 7, wherein said fused material is one selected from a group consisting of fused alloy and synthetic resin.

9. An abrasive tool according to claim 1, wherein said dimples have a width W which is from 30 to 20 times larger than an average diameter of said superabrasive grains.

10. An abrasive tool according to claim 1, wherein said dimples have a depth H which is from 0.5 to 5 times larger than an average diameter of said superabrasive grains.

11. An abrasive tool according to claim 4, wherein each of said dimples has one of a triangular shape or a quadrilateral shape, and wherein an apex of the shape extends in a rotating direction of the wheel.

12. A method of producing an abrasive tool comprising the steps of:

arranging a gel adhesive on a conductive mold to make a plurality of projections;

arranging superabrasive grains on said mold;

applying the superabrasive grains on said mold by electroplating; and removing said mold and projections thereon using an electroformed layer, thus forming an abrasive tool comprising superabrasive grains and having dimples from said projections.

13. The method of producing an abrasive tool comprising the steps of:

arranging a gel adhesive on a conductive mold to make a plurality of projections;

arranging superabrasive grains on said mold;

temporarily applying at least some of the superabrasive grains on said mold by electroplating;

removing non-electroplated superabrasive grains from said mold;

making an electroformed layer to fix said superabrasive grains on said mold by re-electroplating; and removing said mold with said projections thereon, thus forming an abrasive tool comprising said electroformed layer, superabrasive grains on said electroformed layer and having dimples from said projections.

14. The method of producing an abrasive tool according to claim 13, further comprising the steps of:

arranging a core adjacent to the electroformed layer; and filling fused material between said electroformed layer and said core.

15. The method of producing an abrasive tool according to claim 14, wherein said fused material is one selected from the group consisting of fused alloy and synthetic resin.

16. The method of producing an abrasive tool according to claim 13, wherein said gel adhesive is an insulating gel adhesive.

17. The method of producing an abrasive tool according to claim 13, wherein said gel adhesive has a viscosity of 500,000 cP or smaller.

18. The method of producing an abrasive tool according to claim 13, wherein said superabrasive grains are selected from the group consisting of diamond grains and cubic boron nitride grains.

19. The method of producing an abrasive tool according to claim 13, wherein said abrasive tool is a grinding wheel.

20. The method of producing an abrasive tool according to claim 13, wherein said abrasive tool is a diamond dresser and said superabrasive grains are diamond grains.

21. The method of producing an abrasive tool according to claim 20, wherein said diamond dresser includes dimples with a dimple-area-rate of 7 to 70%.

22. The method of producing an abrasive tool according to claim 13, wherein said dimples have a width W which is from 3 to 20 times larger than an average diameter of said superabrasive grains.

23. The method of producing an abrasive tool according to claim 13, wherein said dimples have a depth H which is from 0.5 to 5 times larger than an average diameter of said superabrasive grains.

* * * * *